US005096193A

United States Patent [19]

Lee

[11] Patent Number: 5,096,193

[45] Date of Patent: Mar. 17, 1992

[54] BOWLING BALL HAVING HIGH DENSITY COUNTERWEIGHT

[75] Inventor: Andrew J. Lee, Hopkinsville, Ky.

[73] Assignee: Ebonite International Inc., Hopkinsville, Ky.

[21] Appl. No.: 589,537

[22] Filed: Sep. 28, 1990

[51] Int. Cl.[5] ..... A63B 37/02; A63B 37/12

[52] U.S. Cl. ..... 273/63 E; 273/DIG. 20

[58] Field of Search ..... 273/63 R, 63 A, 63 B, 273/63 C, 63 D, 63 E, 63 F, DIG. 20

[56] References Cited

U.S. PATENT DOCUMENTS 4,320,899 3/1982 Salvino ..... 273/63 E 4,522,397 6/1985 Miller et al. ..... 273/63 D

*Primary Examiner*—George J. Marlo

*Attorney, Agent, or Firm*—Kinzer, Plyer, Dorn, McEachran & Jambor

[57] ABSTRACT

A balanced bowling ball having a core and a shell, and including a counterweight nugget positioned intermediate the bowling ball thumb and finger grip holes. The counterweight nugget comprises a non-metallic material, including refractory tungsten carbide suspended in a matrix of thermoplastic binder, having a density at least an order of magnitude greater than the density of the shell and core materials. The counterweight nugget is disposed within a depression on the core in one embodiment and in a depression in the shell in another embodiment. Alternative methods of manufacturing each embodiment and the material forming the counterweight nugget are also disclosed.

10 Claims, 1 Drawing Sheet

Fig. 1.
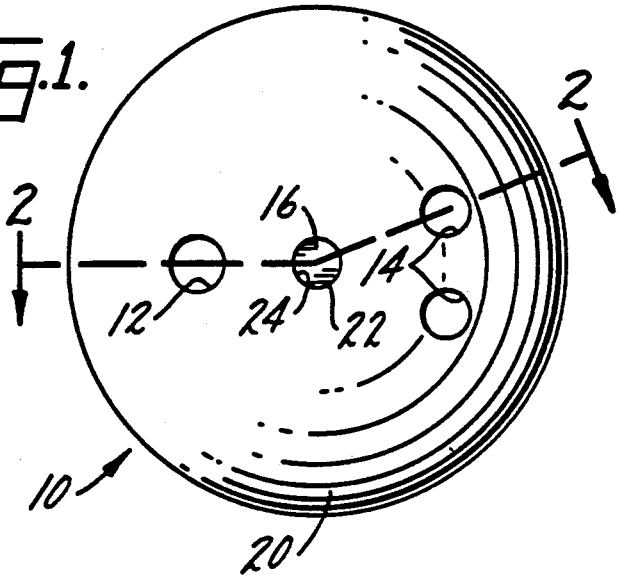
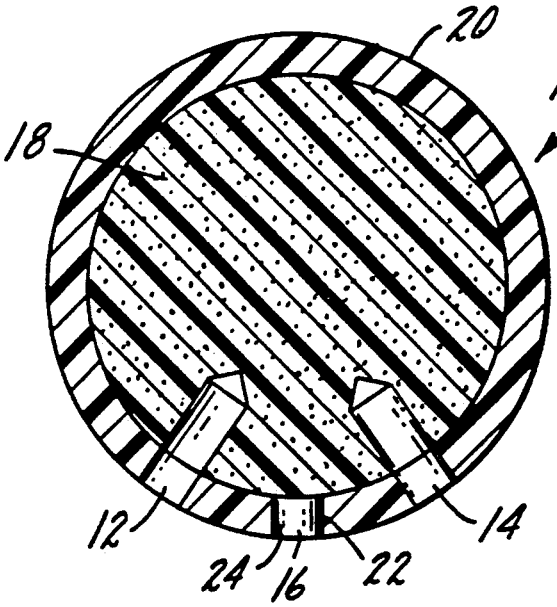
Fig. 2.
Fig. 3.
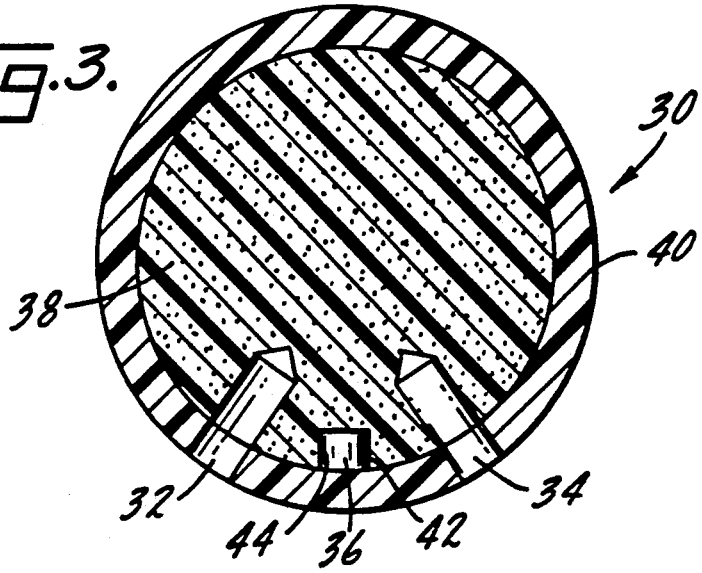

BOWLING BALL HAVING HIGH DENSITY COUNTERWEIGHT

BACKGROUND OF THE INVENTION

1. Field of the Invention

This invention relates generally to bowling balls and more particularly to bowling balls including means for regulating the balance and axial moments of the bowling ball to compensate for finger grip holes.

2. Background Art

Bowling or ten pins has been practiced as a sport for well over a century. More recently, bowling has attained a status as a professional sport. Together with that status and with the popularity of the sport, rules and regulations have been established and promulgated which provide exacting standards for professional play. Everything from the width and length of the bowling lane to the size, shape, weight and composition of the bowling ball must meet specific regulations promulgated by the American Bowling Congress (ABC) in order for play to be recognized as meeting tournament standards.

The ABC rules prohibit the introduction into a bowling ball of metal or any other substance which is not comparable to the original material used in manufacturing a bowling ball. Further, the rules require that a bowling ball be constructed without voids in its interior, that the ball be of a nonmetallic composition material, and that the ball conform to specified weight, size and balance.

A bowling ball includes means for a bowler to hold the ball with one hand. Finger grip holes drilled into the bowling ball provide a grip means, using a configuration having either two finger grip holes or three finger grip holes. Because each bowler's hand measurements are generally different from the measurements of other bowlers, there is a wide range of dimensions in finger grip hole diameter, the depths to which the holes are drilled, and their location relative to each other. The finger grip holes create a void in the bowling ball which must be compensated in order to avoid excessive imbalance in the bowling ball.

A counterweight made from a material which has a higher density than the material comprising the remainder of the bowling ball body has been used to compensate for material drilled out of the bowling ball body to form the finger grip holes. However, the broad variety of individual bowlers' measurements leads to differences in the weight and positioning of the counterweights required.

Prior art attempts to compensate for the material drilled out of the finger holes have been constrained by an inability to provide a high density, nonmetallic counterweight. U.S. Pat. No. 4,121,828 discloses a bowling ball in which the core is composed of two different materials. One material, forming the main mass of the core body, is either plastic or an elastomeric rubberlike material. The other material, also made of plastic or rubberlike material, is embedded within the material comprising the main body of the core. The second material is greater in density than the first material. The bowling ball also is encapsulated by an external shell. The position and orientation of the embedded material is marked so that finger holes drilled into the bowling ball match the counterweight made from the heavier density material embedded in the core.

Because the materials of the core comprise similar plastic or rubberlike materials, the difference in density between them and generally results from a difference in the number of carbon atoms in the elastomeric materials forming the different core materials. Accordingly, the difference in density of the two materials is not great and a substantial quantity of the embedded material is required to compensate for the material drilled out of the finger grip holes.

Moreover, the need to provide two different materials in exacting predetermined ratios requires unnecessarily complex fabricating and indexing procedures to provide proper balance and orientation of the finger grip holes relative to the high density material embedded in the core. Another prior art attempt at solving the problem of bowling ball balance is disclosed in U.S. Pat. No. 3,441,274. That construction contemplates the use of removable plugs to offset weight imbalances created in the normal manufacturing process of the bowling ball. The removal of these plugs creates voids in the body of the bowling ball, voids which are not permitted under tournament regulations. Each of the prior art devices lacks an easily indexed, precisely positionable counterweight means that can adequately and easily compensate for the material which is drilled out of a bowling ball in forming the finger grip holes.

BRIEF SUMMARY OF THE INVENTION

It is a general object of the invention to provide a bowling ball which is essentially balanced with regard to each axis of rotation while simultaneously providing a simple and convenient manufacturing process for fabrication of the bowling ball.

Another object of the invention is to provide a counterweight for a bowling ball that is easily placed and is convenient to insert in a centrally located position between the finger grip holes of a bowling ball.

Another object and significant feature of the invention is to provide a counterweight nugget comprising a smaller, more concentrated mass providing a top weight for a bowling ball than has heretofore been available.

Another object of the invention is to provide a method of manufacture of a bowling ball having a minimum complexity while simultaneously providing a means for balancing the bowling ball which can be easily incorporated into the manufacturing process.

In accordance with these and other objects, a bowling ball is provided which is essentially balanced with respect to all axes of rotation and specifically, a bowling ball which is balanced by use of a concentrated nugget disposed intermediate the finger grip holes of the bowling ball.

Accordingly, in one aspect the invention relates to a bowling ball of the kind comprising a spherical core of given core density and a spherical shell of predetermined shell density encapsulating and bonded to the bore, the core density being approximately equal to the shell density, which ball is adapted to have at least two finger grip holes formed therein at specified locations, with each grip hole extending through the shell and into the core. A counterweight is located in the ball, near its outer surface at a position intermediate the locations for finger grip holes, to balance the ball in compensation for the loss of weight due to removal of the core and shell material from the grip holes when the finger holes are formed. The counterweight is formed of a non-metallic material having a density substantially greater in magnitude than the density of the core or shell materials. The preferred counterweight nugget materials are refractory carbides embedded in thermoplastic resin binders. The counterweight provides a concentrated weight mass that increases the degree of freedom in the location and orientation of finger holes to be drilled in the ball.

BRIEF DESCRIPTION OF THE DRAWINGS

FIG. 1 is an elevation view of a bowling ball including a nugget counterweight according to one embodiment of the present invention;

FIG. 2 is a cross-sectional view of the bowling ball of FIG. 1, taken approximately along line 2—2 in FIG. 1; and FIG. 3 is a sectional view of a bowling ball illustrating a second embodiment of the invention.

DETAILED DESCRIPTION OF THE PREFERRED EMBODIMENTS

A counterweight is a necessary balancing element for any bowling ball which has a body of uniformly dense material and which does not have voids within its interior. A bowling ball 10 incorporating a top weight block counterweight according to one embodiment of the present invention is illustrated in FIGS. 1 and 2. Bowling ball 10 is shown in an elevation view in FIG. 1 and in sectional view in FIG. 2. Bowling balls frequently have finger grip holes which permit the bowler to grip the ball with the thumb and two fingers of one hand. The particular embodiment illustrated in FIGS. 1 and 2 has a thumb grip hole 12 and two finger grip holes 14. A bowling ball may also have only one finger grip hole and a thumb grip hole, an alternative embodiment that is not illustrated. For convenience, the thumb grip hole and one or more finger grip holes may be generally referred to as finger grip holes.

FIG. 2 illustrates in cross section the internal construction of bowling ball 10. The bowling ball includes a core 18 which is encapsulated by and bonded to a shell 20. The finger and thumb grip holes 14 and 12 are drilled through shell 20 and into the core 18. A heavy, concentrated counterweight nugget 16 having a small volume but high density is mounted in shell 20, intermediate holes 12,14. The counterweight nugget 16 provides a top weight counterbalance which compensates for the material removed in drilling of the thumb and finger grip holes.

The advantages provided by having a concentrated counterweight nugget include an increase in the degree of freedom in the location and orientation of the finger holes 12 and 14 relative to the counterweight nugget 16. The weight of the counterweight required to balance the bowling ball is a direct function of the number of holes 12,14 which are drilled in the ball, whether one or two finger holes 14 are provided, the diameter and depth of the holes 12,14, the density of the materials drilled out, and the amount of material which is displaced by the hole 22 drilled into the shell 20 to accommodate the counterweight nugget 16.

The number, width and depth of the holes 12,14 are customer specific, depending on the diameter and length of the bowler's fingers and on the number of finger holes desired. A knowledge of the specific gravity or density of the materials comprising the shell 20 and the core 18 permit a pro shop or other ball vendor to easily calculate the weight of the material removed in drilling the holes 12,14. A major advantage of the high density, low volume counterweight nugget 16 is that the hole 22 can accommodate a wide range of nugget weights. Because of the high density of the material in nugget 16, relatively large weight differences between different customized bowling balls may be compensated by relatively small volume changes. These small differences in volume may be accounted for by filling in the hole 22 with more or less cement 24 to bind the nugget 16 within the hole 22. Thus the size of the hole 22 may be standardized and the final weight of the nugget 16 may be more accurately measured.

Another advantage provided by the present invention is that a low volume, high density counterweight nugget 16 in the shape of a cylindrical plug is easier to locate relative to holes 12,14 than some of the more complicated shapes disclosed in the prior art references. For example, the cylindrical symmetry of the nugget 16 permits the orientation of the holes 12,14 without requiring the manufacturer to take into account the direction and orientation of the higher density material disposed within the core. Of special significance is the avoidance of any requirement to drill the finger holes through any embedded higher density counterweight material, thus alleviating any necessity for burdensome calculation of the amount of material removed from the body of the bowling ball to produce the customized holes 12,14. Moreover, the small size and positioning of the nugget 16 intermediate the holes 12,14 allows for much more accurate and precise balancing of customized bowling balls.

The method of manufacture of bowling balls made according to the embodiment of FIGS. 1 and 2 offers a convenient, less complex fabricating procedure than heretofore known. The core is first manufactured in a spherical shape by casting a thermoplastic material, such as filled polyester or filled polyurethane, in the shape of a sphere. The density of the core 18 may be in a range of from about 0.50 to about 1.50 grams/cubic centimeter (g/cc.) with a preferred optimum density of approximately 1.43 g/cc. for a standard sixteen pound bowling ball.

The external shell 20 is then cast in a spherical configuration around the core 18, encapsulating and bonding the shell 20 to the core 18. The material comprising the shell also preferably comprises a thermoplastic resin, albeit one that is generally more durable and more resistant to damage than the material comprising the core 18. Typical shell materials include polyurethane and polyester resins and hybrid thermoset plastic materials. The density of the shell material should be close to that of the core and generally in a range of from about 1.14 to about 1.20 g/cc.

The next step in the fabrication process is to finish the bowling ball by polishing or otherwise truing the spherical structure of the shell. At this stage of the process, the ball should have a top weight of 0.5 ounces or less. The next steps are spotting the ball and then drilling a hole over the spot in the shell only to a depth required for insertion of the nugget. A nugget of appropriate weight is inserted into the hole and cemented in place so that the surface of the nugget is flush with the shell surface. At this point, the factory manufacturing of the bowling ball is complete, except for engraving, and it is sent to the local representative, such as a pro shop, for drilling of the customized thumb and finger grip holes which will permit the end user to grip the bowling ball.

The counterweight nugget comprises a material which has a substantially greater density and a much smaller total volume than the counterweights which have previously been used. Moreover, because the use of metal in a bowling ball is prohibited by the ABC rules, the counterweight material must be denser while simultaneously not violating those rules. In accordance with these considerations, the counterweight nugget preferably comprises a composite material such as a refractory carbide, preferably a tungsten carbide.

Tungsten carbide has have been used in a variety of applications because of its tensile strength and hardness. The manufacture of tungsten carbide involves the chemical reaction of tungsten in powder form and a carbon compound, e.g., lampblack, at a very high temperature, usually above 1200° C. The resulting powder material has unique properties quite different from either carbon or tungsten. The material is hard and brittle and is properly classified as a ceramic. It is similar to silicon carbide or titanium carbide, which have similar industrial uses. It is widely recognized that these types of materials are not metals or metal alloys, but are, in fact, true inorganic ceramic compounds.

The powdered form of the tungsten carbide cannot normally be used for industrial purposes, and it must be put into a suitable form for its intended uses. For example, in cutting tools and dies, the tungsten carbide powder is bound together in a composite material. The normal procedure is to form a composite material by cementing the tungsten carbide with a metallic binder, such as cobalt, to from a composite material that looks, feels and operates much as a metal would. The function of the binder is to impart toughness and ductility to the composite material and, accordingly, the binder imparts to the material its metallic characteristics. These types of composite materials are normally referred to as cermets, or ceramic/metal composites, and are often mistaken for metallic alloys by the users.

The counterweight nugget according to the present invention also utilizes tungsten carbide ceramic powder. However, the material does not comprise a metallic binder, and is in fact a composite material that comprises tungsten carbide grains which are embedded in or surrounded by a web or matrix made of a resin. This type of composite material lacks the toughness and ductility of the cermet materials, but retains the properties of greater density desired for use in a counterweight for a bowling ball. Moreover, these materials do not have the generally metallic appearance and characteristics which are present in cermets, but appear and act as a composite plastic material, albeit a very dense material. These materials are unique and have no current industrial application because the plastic imparts much less strength and heat resistance to the composite material than a metal binder would. But these properties are not required for use as a counterweight nugget in a bowling ball.

Thus, the preferred material for the counterweight nugget 16 is tungsten carbide embedded in a resin, which preferably is a polystyrene. The proportions of the components of the composite material are not generally significant as long as enough plastic binder is included to maintain the integrity of the nugget. The proportions may range from 50% to 90% weight percent tungsten carbide, with a preferable proportion of approximately 80%. These materials and proportions will impart a density to the nugget material of about 12.0 to about 17.0 g/cc. The preferable density of the nugget material is about 16.0 g/cc.

Sample nuggets weighing approximately 75 grams have been tested in bowling balls. The bowling balls result in a top weight of about 3.0 ounces which is approximately the average weight of the material drilled from the bowling ball body to make the finger and thumb grip holes. A range of weights for the counterweight nugget can be provided for specific dimensions required by the physical characteristics and depending on the desires of the end user.

FIG. 3 illustrates an alternative construction for a bowling ball 30 in which a counterweight nugget 36 is inserted in a hole or depression 42 provided in the core 38 of the ball. An external shell 40 encapsulates both the core 38 and the counterweight nugget 36. Thumb and finger holes 32 and 34 are drilled at positions on either side of the counterweight 36.

The alternative embodiment of FIG. 3 provides a somewhat less cumbersome manufacturing procedure. Following the casting of the material comprising the spherical core 38, a hole or depression 42 is drilled into the core. A counterweight nugget 36 of appropriate weight and shape is inserted into the depression 42. The nugget may fit into hole 42 in a tight friction fit. On the other hand, an optional step of cementing the nugget 36 into the depression 42 may be performed, using a cement 44. The shell 40 is then cast in a spherical shape around both core 38 and nugget 36. The bowling ball 30 is then finished by a conventional polishing step or other optional steps. The location of the nugget 36A in the surface portion of core 38 immediately underlying the shell 40 is identified by spotting of the ball surface, and the bowling ball is shipped to the retail sale location for drilling of appropriate thumb and finger grip holes 32 and 34. Lane tests for the two different bowling ball embodiments 10 and 30 do not show an appreciable difference between their performances.

Other designs for a balanced bowling ball may become apparent once an appreciation and understanding are had of the advantages of the high density, low volume counterweight nugget of the present invention. Accordingly, the above embodiments are for illustrative purposes; the scope of the invention is not limited to them.

What I claim is:

1. In a bowling ball of the kind comprising a spherical core of given core density and a spherical shell of predetermined shell density encapsulating and bonded to the core, the core density being approximately equal to the shell density, which ball is adapted to have at least two finger grip holes formed therein at specified locations, with each grip hole extending through the shell and into the core, a counterweight located in the ball, near the outer surface of the ball, at a position intermediate the locations for finger grip holes, to balance the ball in compensation for the loss of weight due to removal of the core and shell material from the grip holes when the finger holes are formed, the counterweight being formed of a non-metallic material having a density substantially greater in magnitude than the density of the core and the density of the shell materials, the counterweight material comprising a refractory carbide and a non-metallic binder wherein the counterweight provides a concentrated weight mass and increases the degree of freedom in the location and orientation of finger holes to be drilled therein.

2. The bowling ball according to claim 1, wherein the counterweight material comprises tungsten carbide.

3. The bowling ball according to claim 1, wherein the counterweight material comprises a refractory carbide powder embedded in a matrix comprising a thermoplastic resin binder.

4. The bowling ball according to claim 3, wherein the thermoplastic resin binder comprises a polystyrene resin.

5. The bowling ball according to claim 1 in which the counterweight is disposed in the periphery of the core of the bowling ball and is encased by the spherical shell, the counterweight being positioned intermediate the finger grip hole locations so as to symmetrically compensate for the absence of material in the finger grip holes and thereby balance the bowling ball.

6. The bowling ball according to claim 5, wherein the counterweight material comprises tungsten carbide.

7. The bowling ball according to claim 5, wherein the counterweight material comprises a refractory carbide powder embedded in a matrix comprising a thermoplastic resin binder.

8. The bowling ball according to claim 7, wherein the thermoplastic resin binder comprises a polystyrene resin.

9. The bowling ball according to claim 1 in which the counterweight is disposed in the shell of the bowling ball at a position intermediate the finger grip hole locations so as to symmetrically compensate for the absence of material in the finger grip holes and thereby balance the bowling ball.

10. The bowling ball of claim 1 in which the counterweight is cemented into a small hole in the shell or core.

* * * * *